US006022189A

United States Patent [19]

Yu

[11] Patent Number: 6,022,189

[45] **Date of Patent: *Feb. 8, 2000**

[54] CEILING FAN HAVING A ROTATABLE INNER HOUSING

[76] Inventor: Jack Yu, No. 109-1, Avenue 6, Lane 164, Tzong Sa Road, Da Du Hsiang, Taichung Hsien, Taiwan

[ * ] Notice: This patent is subject to a terminal disclaimer.

[21] Appl. No.: 09/093,985

[22] Filed: Jun. 9, 1998

[51] Int. Cl.[7] ..... F04D 29/32

[52] U.S. Cl. ..... 416/5; 416/93 R; 416/170 R

[58] Field of Search ..... 416/5, 93 R, 124, 416/126, 170 R, 175, 203; 417/423.14; 362/96

[56] References Cited

U.S. PATENT DOCUMENTS 4,391,570 7/1983 Stutzman ..... 416/170 R
4,626,970 12/1986 Huang ..... 416/5
5,440,459 8/1995 Chan ..... 416/5
5,441,387 8/1995 Yu .
5,454,692 10/1995 Davis ..... 416/5
5,503,524 4/1996 Yu .
5,655,877 8/1997 Yu .
5,672,048 9/1997 Yu ..... 416/5

*Primary Examiner*—Christopher Verdier

[57] ABSTRACT

A ceiling fan includes an outer housing and a cap secured on top of the outer housing. A motor is disposed in the outer housing for driving a number of fan blades. An inner housing is rotatably disposed in the outer housing and is coupled to the motor by a gear transmission mechanism for allowing the inner housing to be rotated by the motor. An additional motor may be secured on the outer housing and coupled to the inner housing for rotating the inner housing. One or more light bulbs may be disposed in the inner housing for lighting the pattern on the inner housing.

8 Claims, 4 Drawing Sheets

CEILING FAN HAVING A ROTATABLE INNER HOUSING

BACKGROUND OF THE INVENTION

1. Field of the Invention

The present invention relates to a ceiling fan, and more particularly to a ceiling fan having a rotatable inner housing.

2. Description of the Prior Art

A typical ceiling fan is disclosed in U.S. Pat. No. 5,655,877 to the applicant, YU, and comprises an inner housing solidly secured in the outer housing. The inner housing may not be rotated relative to the outer housing.

The present invention has arisen to mitigate and/or obviate the afore-described disadvantages of the conventional ceiling fans.

SUMMARY OF THE INVENTION

The primary objective of the present invention is to provide a ceiling fan having an inner housing rotatably secured in the outer housing.

In accordance with one aspect of the invention, there is provided a ceiling fan comprising an outer housing, a cap secured on top of the outer housing, a motor disposed in the outer housing, a plurality of fan blades secured to the motor and driven by the motor, an inner housing rotatably disposed in the outer housing, and means for rotating the inner housing.

The inner housing rotating means includes an internal gear secured on top of the inner housing, and means for rotating the internal gear. The outer housing includes an annular bracket secured on top thereof, and the annular bracket includes a radially inward portion having an annular flange extended upward therefrom, and the internal gear includes a bottom portion having an annular groove for rotatably receiving the annular flange and for allowing the internal gear to be rotatably secured to the outer housing.

The internal gear rotating means includes means for coupling the internal gear to the motor. Or, a pinion is secured to the motor, and a gear transmission mechanism engaged between the pinion and the internal gear for coupling the internal gear to the motor and for allowing the inner housing and the internal gear to be rotated by the motor via the gear transmission mechanism and the pinion.

The inner housing includes a peripheral portion having a pattern provided thereon. One or more light bulbs are disposed in the inner housing for lighting the pattern of the inner housing. A board is secured to the cap for supporting the light bulbs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
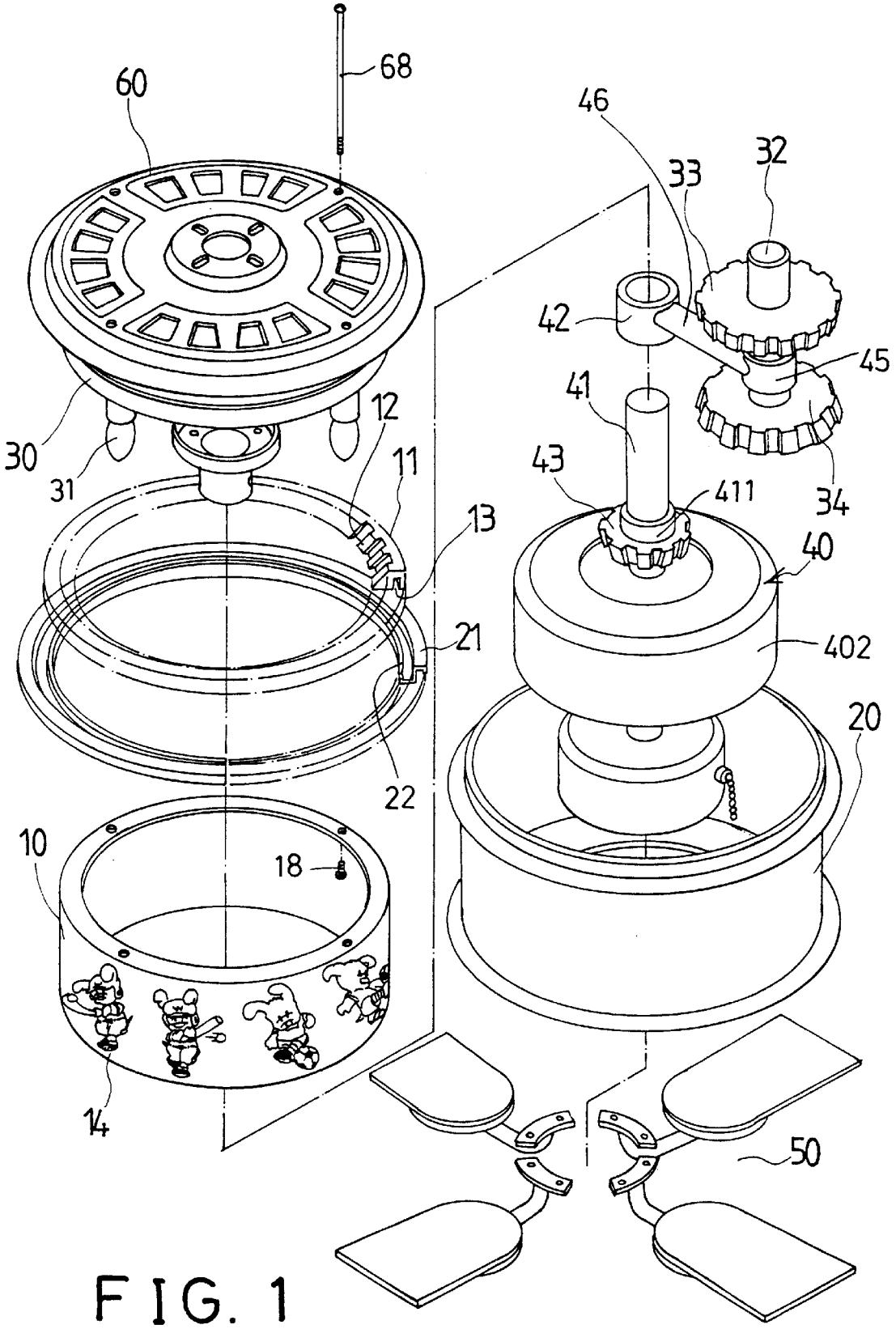
FIG. 1 is an exploded view of a ceiling fan in accordance with the present invention.
Figure 2:
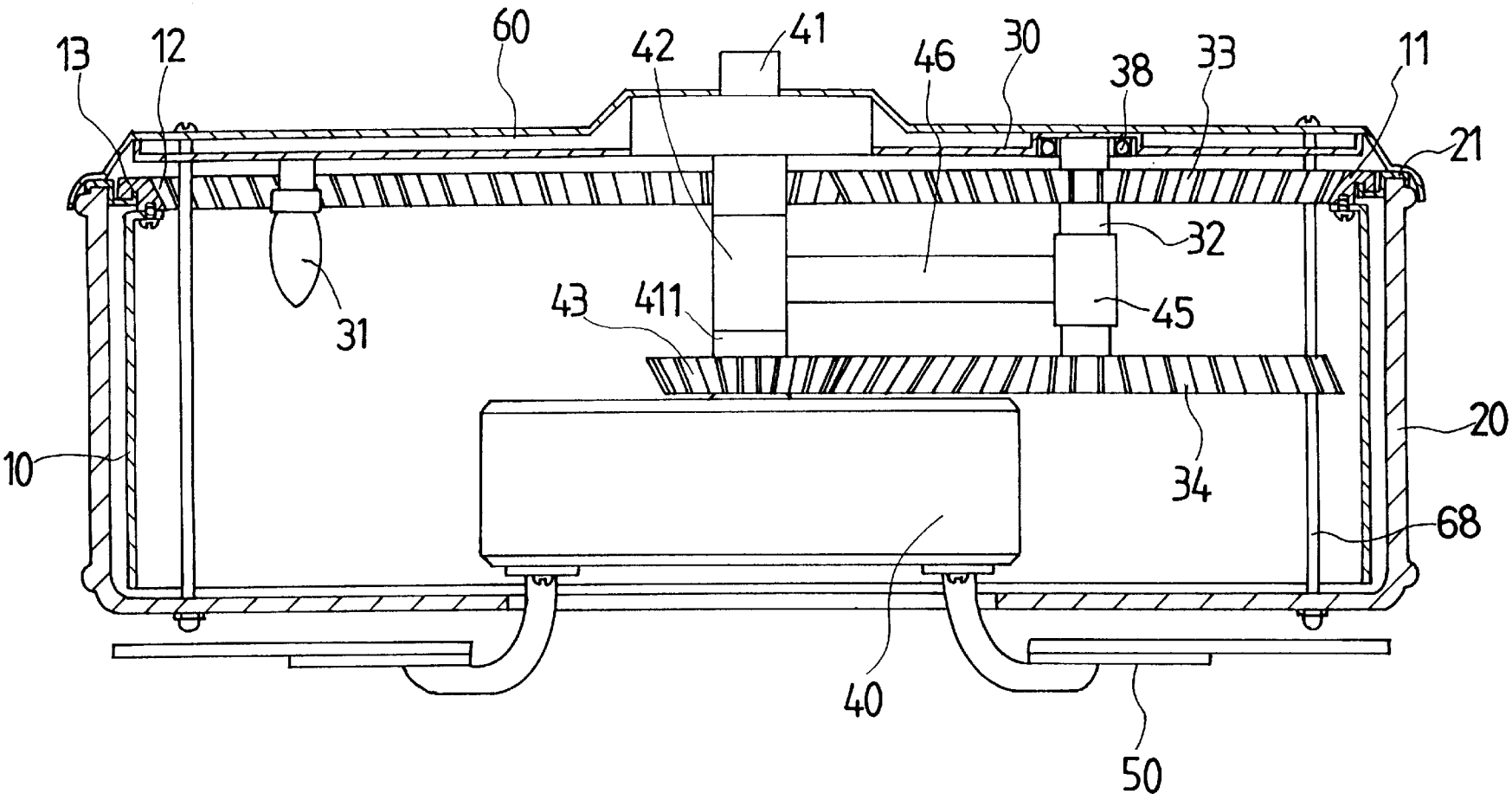
FIG. 2 is a cross sectional view of the ceiling fan as shown in FIG. 1.

Referring to the drawings, and initially to FIGS. 1 and 2, a ceiling fan in accordance with the present invention comprises an outer housing 20, and a cap 60 secured on top of the outer housing 20 by for example fasteners 68. A board 30 is secured to the bottom of the cap 60 for securing one or more light bulbs 31. A spindle 32 has an upper end rotatably secured to the board 30 or to the cap 60 by a bearing 38 and dependent downward from the board 30 or the cap 60, and two gears 33, 34 are secured to the spindle 32 and rotated in concert with the spindle 32. A shaft 41 is vertically secured in the center of the cap 60. A motor 40 is secured to the shaft 41 and includes a rotor 402 rotatable relative to the shaft 41. A pinion 43 is secured on a barrel 411 which is rotatably engaged on the shaft 41 and secured to the rotor 402 of the motor 40 such that the pinion 43 may be rotated by the motor 40. A sleeve 42 is engaged on the shaft 41 and another sleeve 45 is rotatably engaged on the spindle 32 and coupled to the sleeve 42 by a bar 46, such that the spindle 32 and the gears 33, 34 may be stably retained in place. Three or more fan blades 50 are secured to the motor 40 so as to be driven by the motor 40.

An annular bracket 21 has a radially outer portion secured on top of the upper peripheral portion of the outer housing 20 and includes an annular flange 22 extended upward from the radially inward portion. An internal gear 11 includes an annular groove 13 formed in the bottom portion for rotatably receiving the annular flange 22 of the bracket 21 and for allowing the internal gear 11 to be rotatably supported in the outer housing 20. An inner housing 10 has an upper portion secured to the internal gear 11 by such as fasteners 18 and includes a pattern 14 applied to the peripheral portion thereof. The internal gear 11 includes a number of peripheral teeth 12 engaged with the gear 33, and the gear 34 is engaged with the pinion 43 such that the internal gear 11 and the inner housing 10 may be rotated by the motor 40 via the gears.

The pinion 43 preferably includes a size smaller than that of the gear 34, and the gear 33 is smaller than the internal gear 11 such that the inner housing 10 may be rotated at a speed slower than that of the fan blades 50. The outer housing 20 is made of transparent materials, such as acrylic materials or plastic materials or glass materials. In operation, when the fan blades 50 are driven by the motor 40, the inner housing 10 may also be rotated by the motor 40, such that the pattern 14 of the inner housing 10 may be seen through the outer housing 20 in a rotary manner. The pattern 14 may further be clearly seen when the light bulb(s) 31 are energized.

Figure 3:
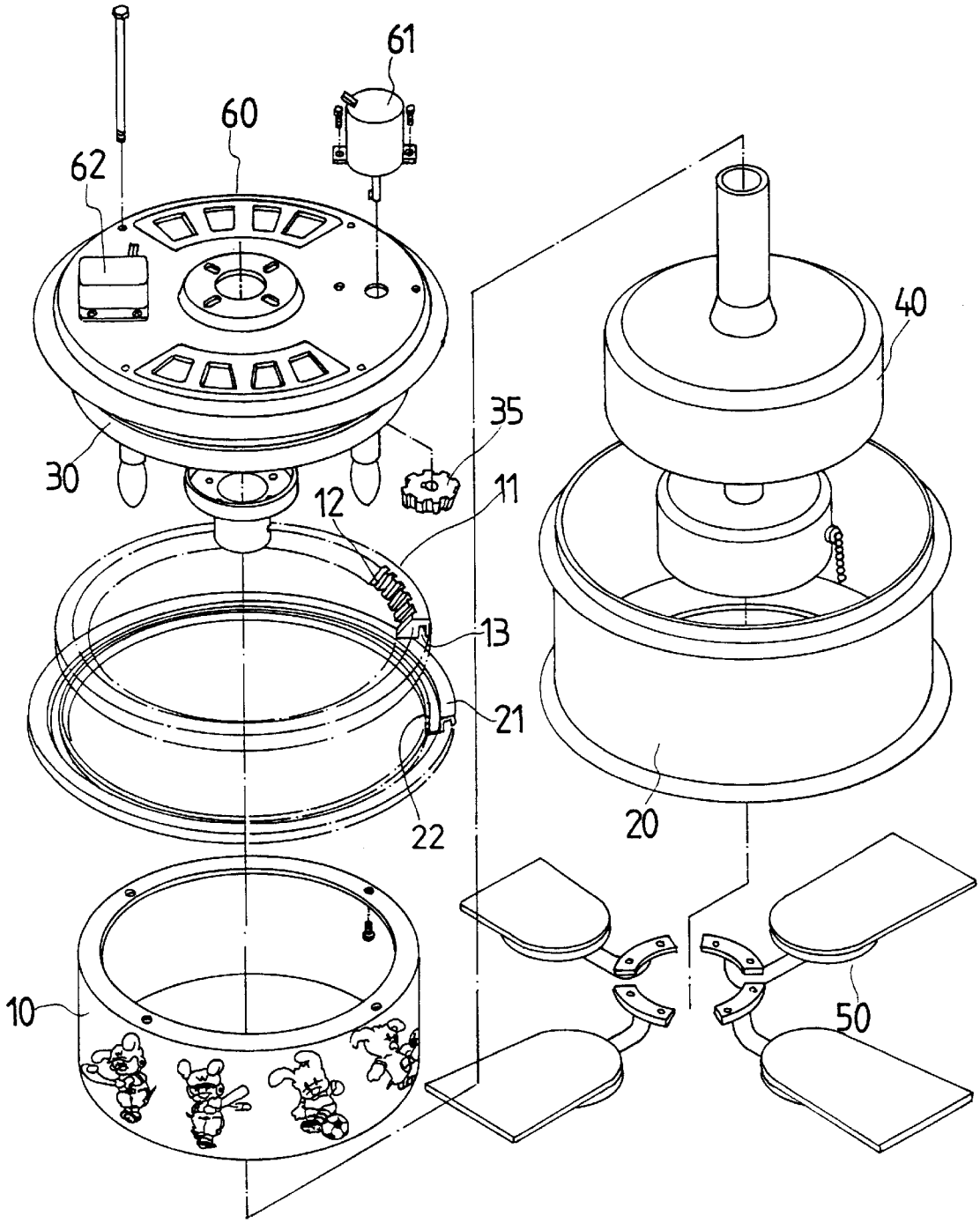
FIG. 3 is an exploded view showing another application of the ceiling fan.
Figure 4:
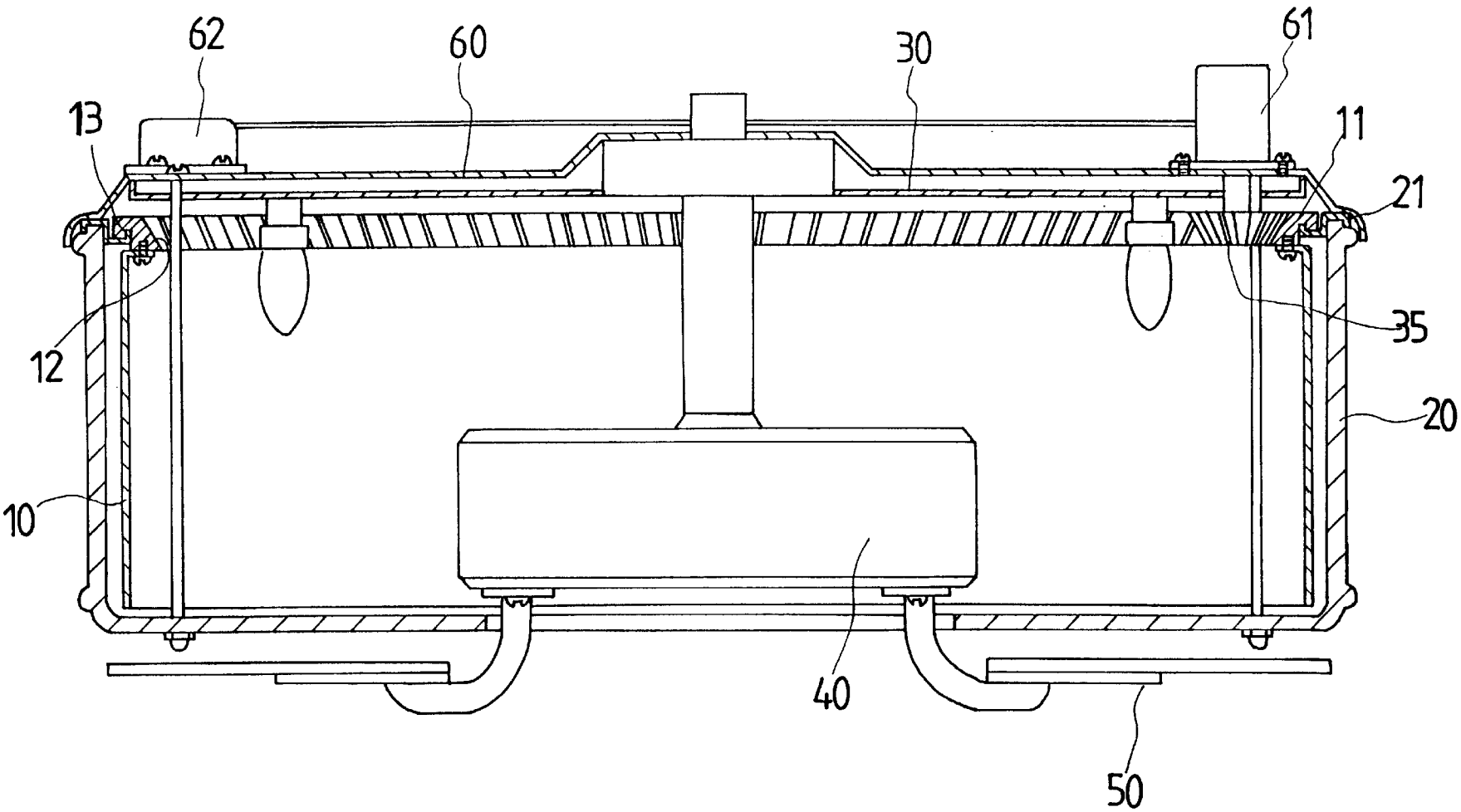
FIG. 4 is a cross sectional view of the ceiling fan as shown in FIG. 3.

Referring next to FIGS. 3 and 4, alternatively, an additional motor 61 is secured on top of the cap 60 and includes a pinion 35 engaged with the teeth 12 of the internal gear 11 for allowing the motor 61 to drive the inner housing 10. An addition electric power 62, such as one or more batteries, may further be secured on top of the cap 60 and coupled to the motor 61 for energizing the motor 61.

Accordingly, the ceiling fan includes an inner housing that may be rotatably secured in the outer housing and that may be rotated by the motor of the ceiling fan or by an additional motor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan comprising:

an outer housing, a cap secured on top of said outer housing, a motor disposed in said outer housing, a plurality of fan blades secured to said motor and driven by said motor, an inner housing rotatably disposed in said outer housing, and means for rotating said inner housing.

2. The ceiling fan according to claim 1, wherein said inner housing rotating means includes an internal gear secured on top of said inner housing, and means for rotating said internal gear.

3. The ceiling fan according to claim 2, wherein said outer housing includes an annular bracket secured on top thereof, said annular bracket includes a radially inward portion having an annular flange extending upward from said radially inward portion of said annular bracket, said internal gear includes a bottom portion having an annular groove for receiving said annular flange, and said annular flange being provided for rotatably receiving said bottom portion of said internal gear and for allowing said internal gear to be rotatably secured to said outer housing.

4. The ceiling fan according to claim 2, wherein said internal gear rotating means includes means for coupling said internal gear to said motor, such that said inner housing and said internal gear are rotated by said motor via said coupling means.

5. The ceiling fan according to claim 2, wherein said internal gear rotating means includes a pinion secured to said motor, and a gear transmission mechanism engaged between said pinion and said internal gear for coupling said internal gear to said motor and for allowing said inner housing and said internal gear to be rotated by said motor via said gear transmission mechanism and said pinion.

6. The ceiling fan according to claim 1, wherein said inner housing includes a peripheral portion having a pattern provided thereon.

7. The ceiling fan according to claim 1 further comprising at least one light bulb disposed in said inner housing for lighting said inner housing.

8. The ceiling fan according to claim 7 further comprising a board secured to said cap for supporting said at least one light bulb.

* * * * *